United States Patent [19]

Kuge et al.

[11] 4,346,986

[45] Aug. 31, 1982

[54] IMAGE FORMATION METHOD AND APPARATUS

[75] Inventors: Tsukasa Kuge, Tokyo; Yasuyuki Tamura, Kawasaki; Koichi Tanigawa, Tokyo, all of Japan

[73] Assignee: Canon Kabushiki Kaisha, Tokyo, Japan

[21] Appl. No.: 231,110

[22] Filed: Feb. 3, 1981

Related U.S. Application Data

[63] Continuation of Ser. No. 969,887, Dec. 15, 1978, abandoned.

[30] Foreign Application Priority Data

Dec. 22, 1977 [JP] Japan ..... 52-154623

[51] Int. Cl.[3] ..... G03G 15/02; H01T 19/00

[52] U.S. Cl. ..... 355/14 CH; 355/3 CH; 361/235

[58] Field of Search ..... 355/3 R, 3 CH, 14 R, 355/14 CH; 361/235

[56] References Cited

U.S. PATENT DOCUMENTS

| | | | |
|---|---|---|---|
| 3,604,925 | 9/1971 | Snelling | 355/3 CH X |
| 3,699,388 | 10/1972 | Ukai | 361/235 X |
| 3,714,531 | 1/1973 | Takahashi | 361/235 X |
| 3,788,739 | 1/1974 | Coriale | 355/3 R X |
| 3,819,942 | 6/1974 | Hastwell et al. | 361/235 X |
| 4,000,944 | 1/1977 | Fraser | 355/14 R |
| 4,019,102 | 4/1977 | Wallot | 355/14 CH X |
| 4,028,596 | 6/1977 | Weber | 361/235 |
| 4,136,942 | 1/1979 | Nakahata et al. | 355/3 CH |

*Primary Examiner*—Fred L. Braun

*Attorney, Agent, or Firm*—Fitzpatrick, Cella, Harper & Scinto

[57] ABSTRACT

An image forming apparatus includes a plurality of devices for forming an image on a rotatable medium and transferring the image onto transfer material. A detector is provided to detect the electrical condition of one of the devices during an initial turn of the rotatable medium prior to image processing. Electrical circuitry then controls the electrical condition of the one device to approach a predetermined value which value is then held for controlling the device during image formation.

8 Claims, 18 Drawing Figures

IMAGE FORMATION METHOD AND APPARATUS

This is a continuation, of application Ser. No. 969,887, filed Dec. 15, 1978, now abandoned.

BACKGROUND OF THE INVENTION

1. Field of the Invention

This invention relates to a method of and an apparatus for stably forming a proper image.

2. Description of the Prior Art

For example, an exposure light source, a corona charger and a developing unit are generally used to form an image on a photosensitive medium. Corona charging is effected with discharging taking place in the air and so, the corona discharging condition is varied by variations in environmental conditions such as humidity, temperature and atmospheric pressure and by contamination of the discharging wire attributable to the suspensions in the air, and accordingly the quantity of electric current directed toward a member to be charged is varied to thereby vary the potential of the member to be charged. This results in pronounced variations in the developed image in the electrophotography wherein an electrostatic latent image is formed on the member to be charged and developed into a visible image. To stabilize the condition of the formed image, the charging effected on the member to be charged by corona discharge must be made stably or some method must be adopted to compensate for the variation in the latent image potential resulting from the variation in charging on the member to be charged.

A method disclosed in U.S. Pat. No. 2,956,487 is known as the method for providing a stable image. It is also known to use a constant current source as the power source for the corona charger and impart a constant quantity of corona discharge current to the charged member.

However, where the surface potential before the charged member is subjected to said charging is not constant or where the electrostatic capacity between the charged member and the earth is not constant, the charged member cannot be charged to a constant potential.

The reason will hereinafter be described. Generally, if the electrostatic capacity of the charged member is C, the variation in surface potential of the charged member resulting from charging is $\Delta V$ and the charge imparted to the charged member by charging is $\Delta Q$, then $\Delta Q$ may be expressed as $\Delta Q = C\Delta V$. In the charging method wherein a constant quantity of effective corona discharge current is imparted to a charged member, $\Delta Q$ is a constant value determined by the charging time and the effective corona discharge current.

Here, if the electrostatic capacity C of the charged member is varied with time or the like, the amount of variation $\Delta V$ of the surface potential of the charged member resulting from the charging is varied since $\Delta Q$ is constant and so, the surface potential of the charged member after subjected to the charging is not constant. Also, even if the amount of variation $\Delta V$ of the surface potential resulting from the charging is constant, the surface potential of the charged member after being subjected to the charging is not constant unless the surface potential of the charged member before being subjected to the charging is constant.

SUMMARY OF THE INVENTION

It is an object of the present invention to eliminate the above-noted disadvantages and to provide an image formation method and apparatus for stably providing a proper image.

It is another object of the present invention to provide an image formation method and apparatus for stably forming a proper image independently of the electrostatic condition of a recording medium before the image formation.

It is still another object of the present invention to provide a method of and an apparatus for forming an image by providing a constant charged condition independently of the environmental conditions such as temperature, humidity, atmospheric pressure, etc. and by charging a charged member to a constant potential irrespective of the condition of the surface potential of the charged member and the electrostatic capacity thereof.

It is also an object of the present invention to stably control the image forming conditions such as the surface potential, etc. without hampering the speed of the image formation process.

It is a further object of the present invention to stably control the image forming conditions by utilizing the prepartory processes such as the pre-exposure executed before the initiation of the image formation in an image transfer type copying machine.

It is still a further object of the present invention to provide an image formation method and apparatus in which a plurality of process factors such as chargers may each be stably controlled even if they are operating with respect to a common recording medium at a time.

It is also an object of the present invention to indirectly detect the surface potential of a charged member in its standard condition to control the high voltage output and thereby render the surface of the charged member to a predetermined potential and to hold the signal for rendering the surface of the charged member to the predetermined potential and charge the charged member by the output held thereafter.

As a specific example, a charged member having an electrostatic capacity and a surface potential maintained in the reference condition is first disposed and then, the condition of the output voltage or the output voltage waveform of a high voltage source is automatically regulated so that the corona discharge current effective for the charging is rendered to a predetermined value. The corona discharge current effective for the charging is represented by the difference in absolute value between the positive current and the negative current in the AC corona discharge, while it is represented by the current value in the DC corona discharge. The reference condition corresponds to the case where a predetermined area of the charged member is uniformly exposed to light, uniformly shielded from light, uniformly discharged or uniformly charged.

As a second stage, the condition of the high voltage source achieved in the first stage or a control signal corresponding to the condition of the high voltage source is stored by memory means directed for such purpose, and the condition of the high voltage source is fixed.

If charging is effected on any desired charged member after the first and the second stage, the charged member is charged by a predetermined high output voltage or a high output voltage waveform in spite of the high output voltage or the high output voltage waveform being automatically regulated in accordance with the environmental conditions. As the result, it is possible to provide a substantially constant and uniform surface potential without decreasing the process speed, in spite of the variations in the environmental conditions, and the condition of the charged member.

The invention will become more fully apparent from the following detailed description thereof taken in conjunction with the accompanying drawings.

DESCRIPTION OF THE PREFERRED EMBODIMENTS

Description will hereinafter be made by taking electrophotography as an example.

The following two methods are now widely used as a typical electrophotographic method.

A first method comprises subjecting a two-layer photosensitive medium comprising a photoconductive layer and a conductive substrate to a primary charge of the positive or the negative polarity, subsequently applying image light to the photosensitive medium to thereby form an electrostatic latent image thereon, and further subjecting the photosensitive medium to a developing process to thereby provide a visible image.

A second method comprises subjecting a three-layer photosensitive medium comprising a transparent insulating layer, a photoconductive layer and a conductive substrate to a primary charge of the positive or the negative polarity, subsequently applying image light and secondary charge to the photosensitive medium, and further uniformly exposing the photosensitive medium to light to thereby form an electrostatic latent image thereon, and subjecting the photosensitive medium to a developing process to thereby provide a visible image.

Figure 1:
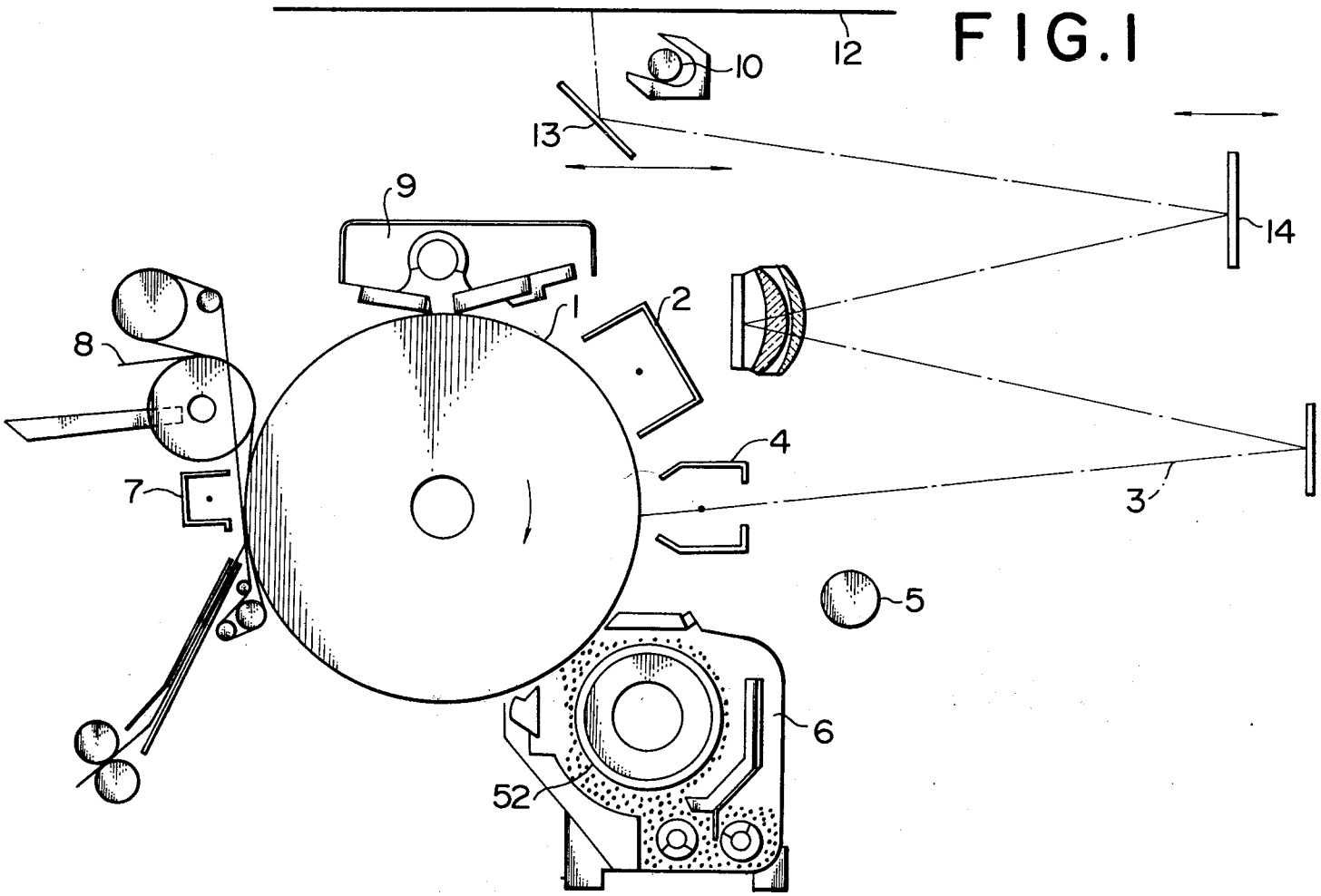
FIG. 1 illustrates the process in a copying machine to which the present invention is applicable.

FIG. 1 shows the process of the latter method. Designated by 1 is a photosensitive medium rotatably in the direction of arrow. Denoted by 2 is a primary charger, and 3 the optic axis of the light image when an original 12 is illuminated by a lamp 10. The light image is provided by scanning the original by the reciprocal movement of mirrors 13 and 14 synchronous with the rotation of the photosensitive medium. Designated by 4 is a secondary charger, 6 a developing unit, 7 an image transfer charger for transferring the visible image onto transfer paper 8, and 9 a blade cleaner for cleaning the photosensitive medium after the visible image has been transferred onto the transfer paper 8.

The charging method used in this electrphotographic process utilizes DC corona discharge or AC corona discharge and for example, in FIG. 1, it usually utilizes DC corona discharge as the primary charger 2 and the image transfer charger 7 and AC corona discharge as the secondary charger.

Figure 2A:
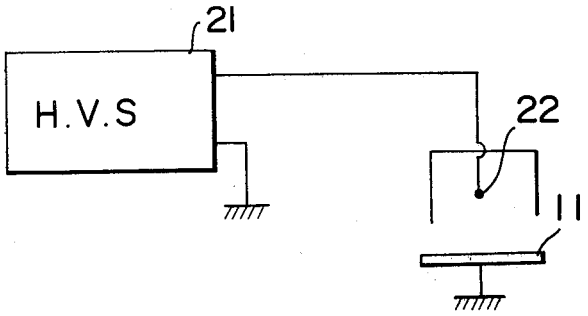
FIG. 2A is a schematic diagram of a conventional corona discharge device.

An example of the conventional charger of the simplest construction is shown in FIG. 2A, wherein numeral 21 designates a high voltage source, 22 a corona discharge wire and 11 a photosensitive medium.

An AC power source or a DC power source is used as the high voltage source 21. A voltage greater than a corona discharge starting voltage Vc is applied to a corona discharge electrode 22 to thereby produce a corona discharge current and impart the charge thereof to the surface of the photosensitive medium.

In electrophotography, it is important to ensure an electrostatic latent image of a predetermined surface potential to be obtained with a good reproducibility in accordance with the original image. The influence of the corona charge upon the electrostatic latent image is great and therefore, to stabilize the surface potential, not only the charger of FIG. 2A must have a constant opening width of the shield case of the corona discharger and a constant distance between the corona discharge wire and the photosensitive medium, but also it must be used with the environmental conditions such as temperature and humidity being constant.

Figure 2B:
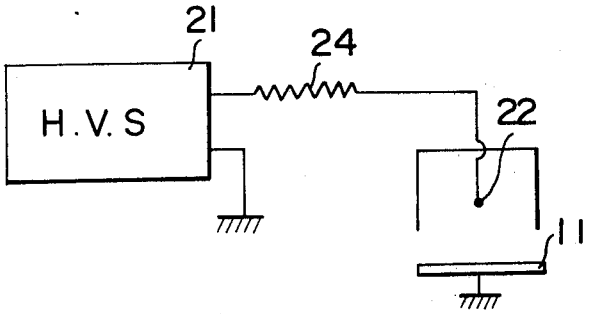
FIGS. 2B and 2C are schematic diagrams of conventional discharge devices for reducing fluctuation in surface potential.
Figure 2C:
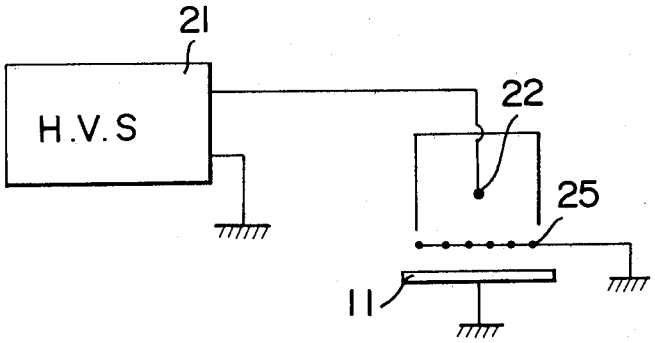

FIG. 2B and 2C show conventional charging devices intended to decrease the variation in surface potential when the foregoing conditions fluctuate. In FIG. 2B, a resistor 24 is inserted in series on the high voltage output side of a high voltage source 21, and in FIG. 2C, a grid 25 is disposed between the corona discharge wire and the photosensitive medium 1. In any of these, the fluctuation in corona resistance resulting from variations in the environmental conditions or from irregularity of the distance between the corona discharge wire and the surface of the photosensitive medium cannot be sufficiently compensated for and the resultant stability of the surface potential and the stability of the finally obtained visible image is unsatisfactory. For example, the fluctuation of the surface potential resulting from the fluction of the atmosphere from normal temperature and normal humidity to high temperature and high humidity causes an inconvenience that fog is produced in the visible image obtained after the development.

Therefore, if a charging method of imparting a predetermined amount of effective corona discharge current to the surface of the photosensitive medium is used to charge the surface of the photosensitive medium, the surface potential of the photosensitive medium will be very stable irrespective of the fluctuations of the environmental conditions such as temperature, humidity, atmospheric pressure, etc., and there will be obtained a constant surface potential.

Consideration will now be given to the case where the charging method of imparting a predetermined amount of effective corona discharge current is applied for the primary charging in the aforementioned first and second electrophotographic methods. The electrostatic capacity of the photosensitive medium is considered to be constant when primary charge is imparted. However, before the primary charge is applied, the surface potential of the photosensitive medium is usually very non-uniform. For example, in the electrophotographic apparatus shown in FIG. 1, the photosensitive medium 1 is already subjected to the charge from the image transfer charger 7 before it is subjected to the charge from the primary charger 2. However, the corona current from the image transfer charger 7 is interrupted by transfer paper 8 during the image transfer and only a very small amount of corona current reaches the surface of the photosensitive medium, whereas when the transfer paper 8 is not supplied to the front of the image transfer charger 7, most of the corona current from the image transfer charger 7 reaches the photosensitive medium 1. Usually, image transfer is intermittently effected as required and so, very non-uniform potential is produced on the surface of the photosensitive medium 1 which has passed by the front of the image transfer charger 7.

As an example, when transfer paper 8 was in front of the image transfer charger 7, the surface potential of that portion of the photosensitive medium prior to the next application of the primary charge was +300 V, whereas when transfer paper 8 was not in front of the image transfer charger 7, the surface potential of that portion of the photosensitive medium prior to the next application of the primary charge was +800 V.

The potential prior to the application of the primary charge is varied under the influence of the previously formed electrostatic latent image.

Therefore, where the charging method of imparting a predetermined amount of effective corona discharge current to a member to be charged, as already described, is used for the primary charging in the electrophotographic method, the surface potential after the primary charging is very non-uniform.

Where the charging method of imparting such a predetermined amount of effective corona discharge current is used for the discharging which takes place simultaneously with the exposure to the image light in the second electrophotographic method, it is difficult to form an electrostatic latent image having a sufficient contrast.

That is, in this electrophotographic method, discharging takes place at the same time with the exposure to the image light and the photoconductive layer in the photosensitive medium acts substantially as a conductor or an insulator in accordance with the light and dark of the image light, so that the effective electrostatic capacity is varied. The electrophotographic method is such that differences in amount of charge are formed on the surface of the photosensitive medium in accordance with the light and dark of the image light by rendering the photosensitive medium into a uniform potential irrespective of the light and dark of the image light during the discharging, whereafter light is uniformly applied to the photosensitive medium to render the photoconductive layer in the photosensitive medium conductive to thereby form an electrostatic latent image of high contrast in accordance with the charge present on the surface of the photosensitive medium. Therefore, as the condition after the discharging, it is desirable that the difference in amount of charge corresponding to the light and dark of the image light be great and the surface potential be constant irrespective of the light and dark of the image light, i.e., the difference in effective electrostatic capacity of the photosensitive medium.

Where the charging method of imparting a predetermined amount of effective corona discharge current, as described above, is used, a predetermined amount of charge is imparted to the surface of the photosensitive medium irrespective of the variation in effective electrostatic capacity of the photosensitive medium and therefore, it is difficult to form a difference in amount of charge corresponding to the light and dark of the image light after the discharging and accordingly, it is not possible to obtain an electrostatic latent image of high contrast.

Reference is now had to FIGS. 3 to 9 to describe a specific embodiment of the present invention.

Figure 3:
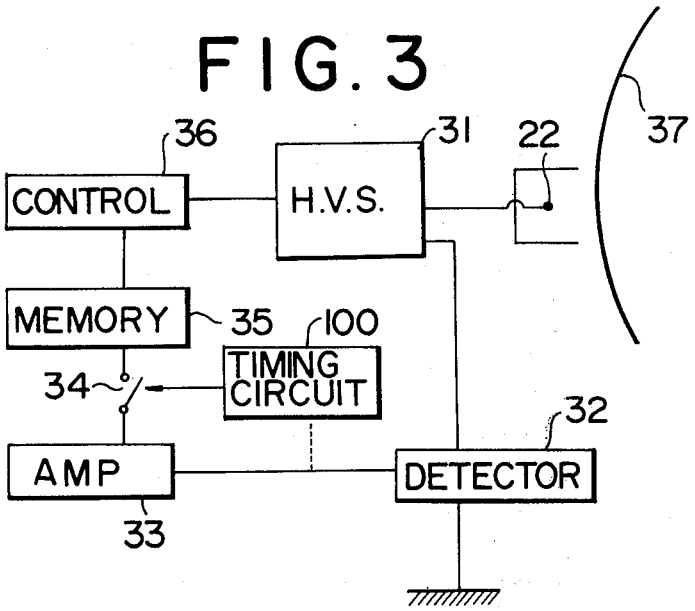
FIG. 3 is a block diagram for illustrating the charging method and apparatus according to the present invention.

FIG. 3 is a block diagram of the charge control device in the present invention.

A high voltage output generated by a high voltage generating unit 31 is directed to a discharge electrode 22 to impart corona discharge charge to a member 37 to be charged.

On the other hand, effective corona discharge current is detected by a current detecting unit 32 and the detected signal is compared with a reference signal at a comparing amplifying unit 33 which generates a control signal. The control signal is delivered through a switch 34 to a memory unit 35, in which the control signal is stored. At the same time, the control signal is delivered to a control unit 36, which controls the high voltage output in accordance with the control signal so that the corona discharge current becomes proper.

Here, as a first stage in charging, a member maintained at a reference condition is disposed as the member 37 to be charged and corona discharge is effected so that the corona discharge current detected by the current detecting unit 32 assumes a predetermined value, whereafter a second stage is entered. As the second stage, the switch 34 is opened to cut off the control signal from the detecting unit 32, and a high output voltage level or a high output voltage waveform is maintained constant by the control signal stored in the memory unit 35 for effecting a predetermined corona discharge, whereby corona discharge may be effected to charge the member to be charged, which is at any given potential, to a constant level. Since the detecting unit 32 is provided at the low voltage side of the high voltage generating unit 31, each of a plurality of chargers provided at different portions of the high voltage generating unit for a common photosensitive medium may be accurately controlled independently even if those chargers are operated at the same time.

FIGS. 4 to 8 shows the circuit arrangements of the charging devices in which the present invention is utilized for various corona dischargers.

Figure 4:
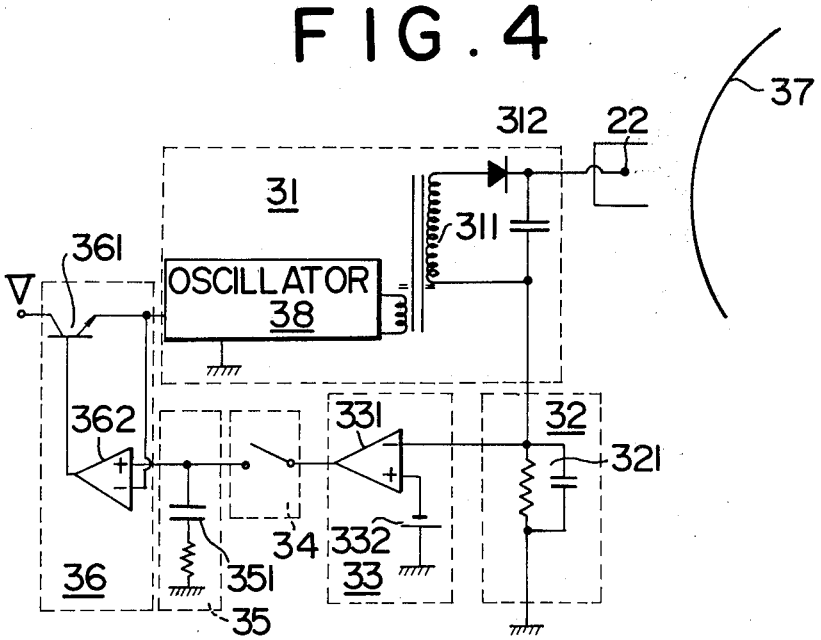
FIGS. 4–9 show examples of the circuit for illustrating the charging method and apparatus according to the present invention.

FIG. 4 shows an application of the present invention to plus corona discharge. Likewise, it may be applied to minus corona discharge.

In FIG. 4, numeral 38 denotes a well-known oscillator whose oscillation output voltage is varied in accordance with input voltage, 311 a booster transformer, 312 a rectifier for effecting plug charging, 321 a resistor for detecting as a voltage drop the effective current for the charging by corona discharge, 331 an operational amplifier for comparing the drop voltage with a reference voltage source 332 and putting out an output corresponding to the difference therebetween, 351 a capacitor for sample-holding the output from the amplifier 331, and 362 an amplifier for controlling the amount of power supplied to a control transistor 361 in accordance with the value held by the capacitor 351.

Now, when the environment is at a lower temperature and higher humidity than usual, the corona discharge current provided by the discharge current 22 is decreased so that the charge potential is decreased below a predetermined level. When the member is to be charged is at a reference condition, the detecting resistor 321 detects a variation therein and the capacitor 351 is charged through the switch 34 by the amplifier 331 in accordance with the variation and the output of the amplifier 362 is increased, so that the amount of power supply to the transistor 361 is increased and the input voltage of the oscillator 38 is increased. Accordingly, the output of the high voltage transformer 31 is increased to increase the discharge current and restore a predetermined charging potential. Before the member to be charged assumes a non-reference condition, the switch 34 is opened and thereafter, the output of the amplifier 362 is held by the charging potential of the capacitor 351 and the corona discharge is continued by the amount of power supply from the transistor 361. Further, the output of the transistor 361 is fed back to the amplifier 362 so as to hold a predetermined output and further enhance the holding effect.

Figure 5:
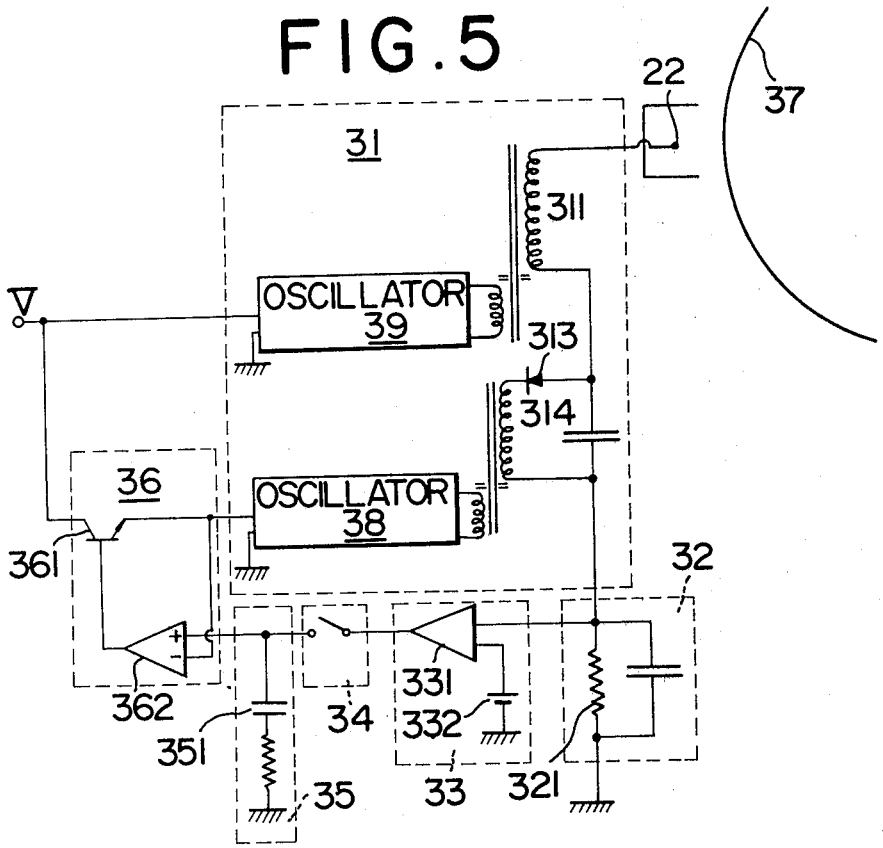

FIG. 5 shows an example in which the present invention is applied to corona charge using a power source comprising a combination of an AC voltage source and a DC voltage source. Designated by 39 is an oscillating circuit for generating a predetermined output independently of 38, and 313 is a diode for increasing the negative component in AC waveform.

In this example, the charging potential is not determined by the total current for the discharge electrode 22, but the sense of charging (direction of polarity) and the surface potential are determined by the difference between the plus component and the minus component of the current resulting from the AC corona flowing through the electrode (hereinafter referred to as the current difference).

Here, the current difference has the negative sense of charging due to the diode 50 and negatively charges the member to be charged. The current difference resulting from the AC corona discharge is detected by a detecting resistor 321 which detects the difference in AC, and the difference detected by a comparator 331 is compared with the reference value of the voltage source 332, and the amplifier 331 charges the capacitor 351 through the switch 34 in accordance with the detected value and puts out a control signal to the amplifier 362.

The input of the oscillator 38 is controlled by a control transistor 361 through the amplifier 362 so that the current difference may assume a predetermined value. Next, the switch 34 is opened by a timing signal from outside, and a DC signal is imparted to the oscillator 38 under the stored signal in the memory circuit 35 which makes the current difference constant, whereby corona discharge is continued at a predetermined current difference.

Figure 6:
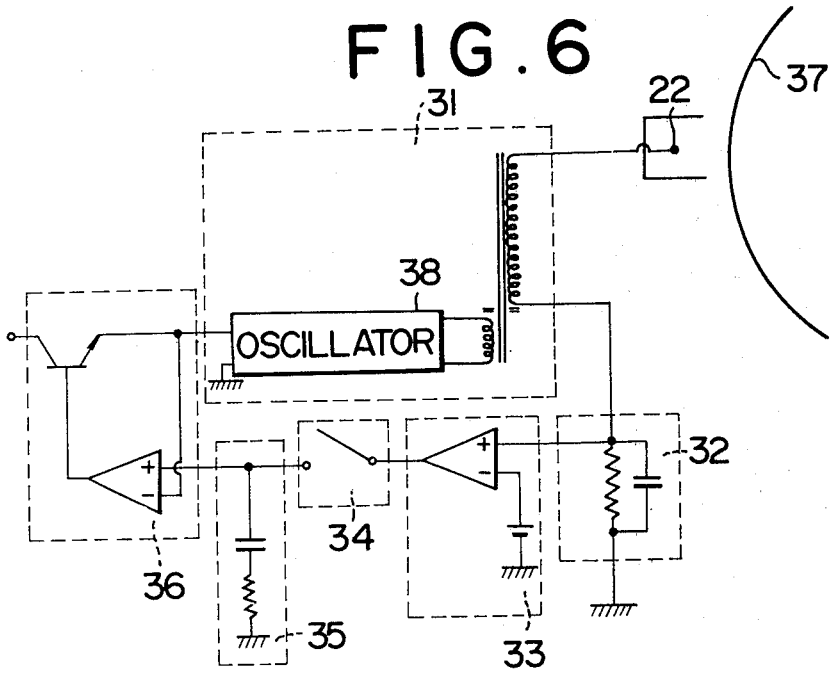

FIG. 6 is an example in which the present invention is applied to a charging device using AC corona discharge. This example may be exclusively used to uniformly remove the surface charge.

Figure 7:
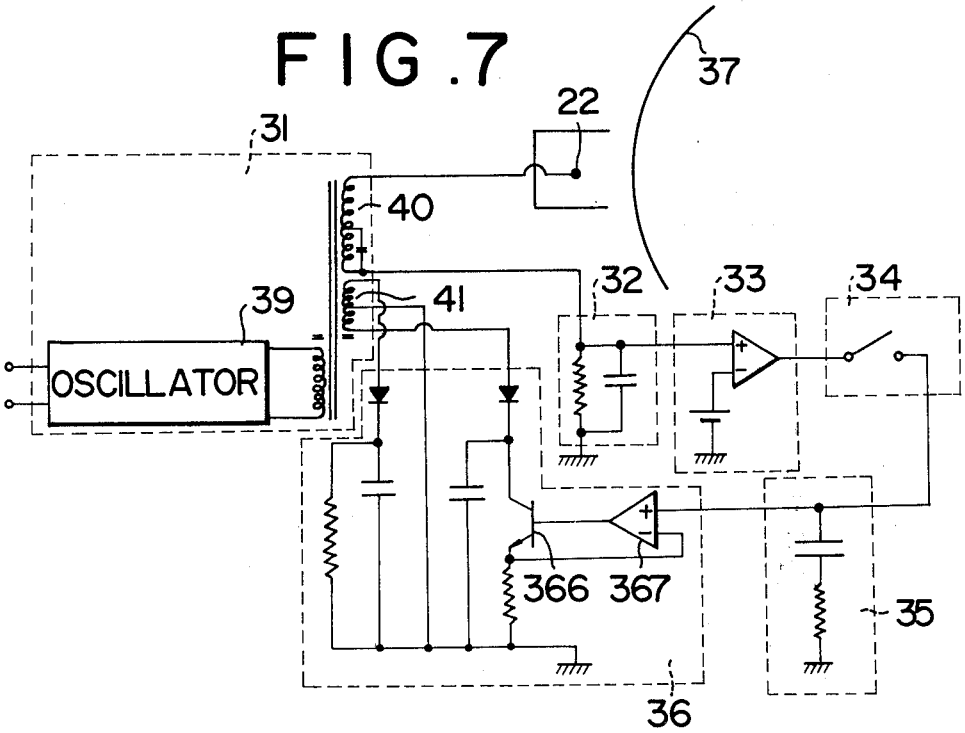

FIG. 7 shows an example in which the present invention is applied to AC corona discharge and this is characterized in that it has an output control winding 41 magnetically coupled to the high voltage output generating winding 40 of the high voltage transformer, in addition to the output winding of the oscillator 39. The waveform of the voltage generated in the high voltage output generating winding 40 is distorted by the current flowing through the output control winding 41, whereby the efficiency of the positive and negative corona discharges is varied.

Accordingly, in the circuit of FIG. 7, the current flowing through the output control winding 41 is controlled by the detector circuit 32 and the memory circuit 35, thereby controlling the difference in absolute value between the positive and the negative component of the corona discharge current.

The output control winding 41 may be provided independently from the high voltage output generating winding 40, as shown in FIG. 7, or alternatively a portion of the high voltage output generating winding 40 may be common to the output control winding 41.

Figure 8:
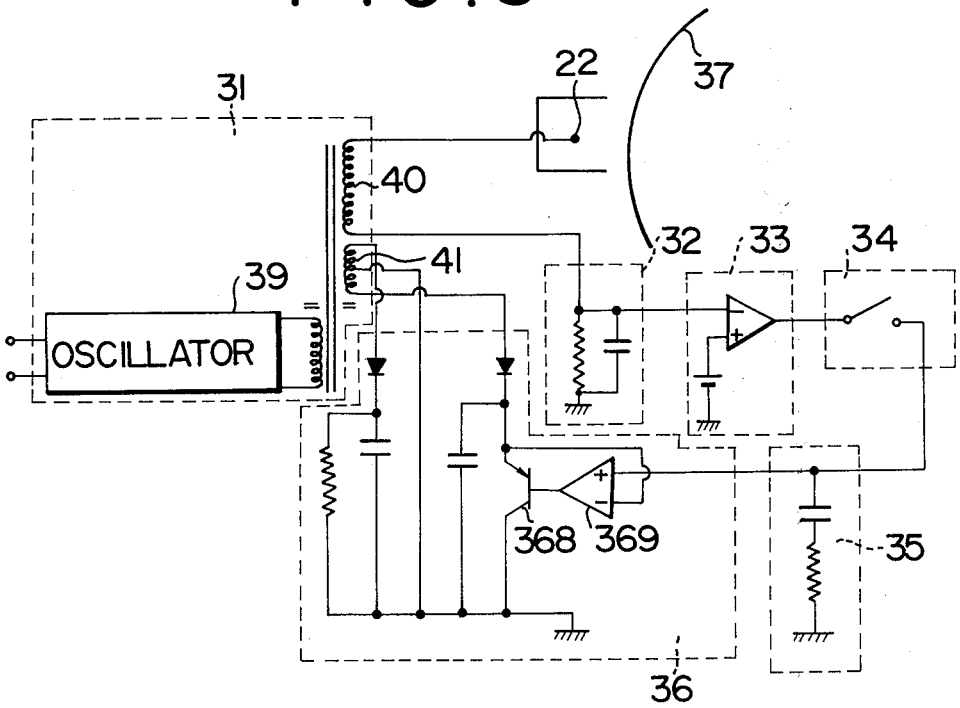

FIG. 8 is similar to FIG. 7, but this is intended to control the voltage across the terminal of the output control winding 41 instead of controlling the current of the output control winding 41. Accordingly, the circuit of FIG. 8, as compared with the circuit of FIG. 7, has an advantage that it provides a voltage source excellent in constant voltage characteristic after the switch 34 is opened.

In FIGS. 7 and 8, the outputs of transistors 366 and 368 are fed back to amplifiers 367 and 369 and therefore, the control output becomes more constant.

Description will now be made of the operation timing of the switch 34.

Whether or not the charged member is in reference condition at the first stage is indirectly known from the signal from the apparatus incorporating the charger, for example, the copying machine. Accordingly, changeover of the control mode can be effected by opening the switch 34 by this signal. For example, where the photosensitive medium is rendered to a uniform potential by pre-exposure and pre-charging, the switch 34 may be opened when the process period comes to an end.

Figure 9:
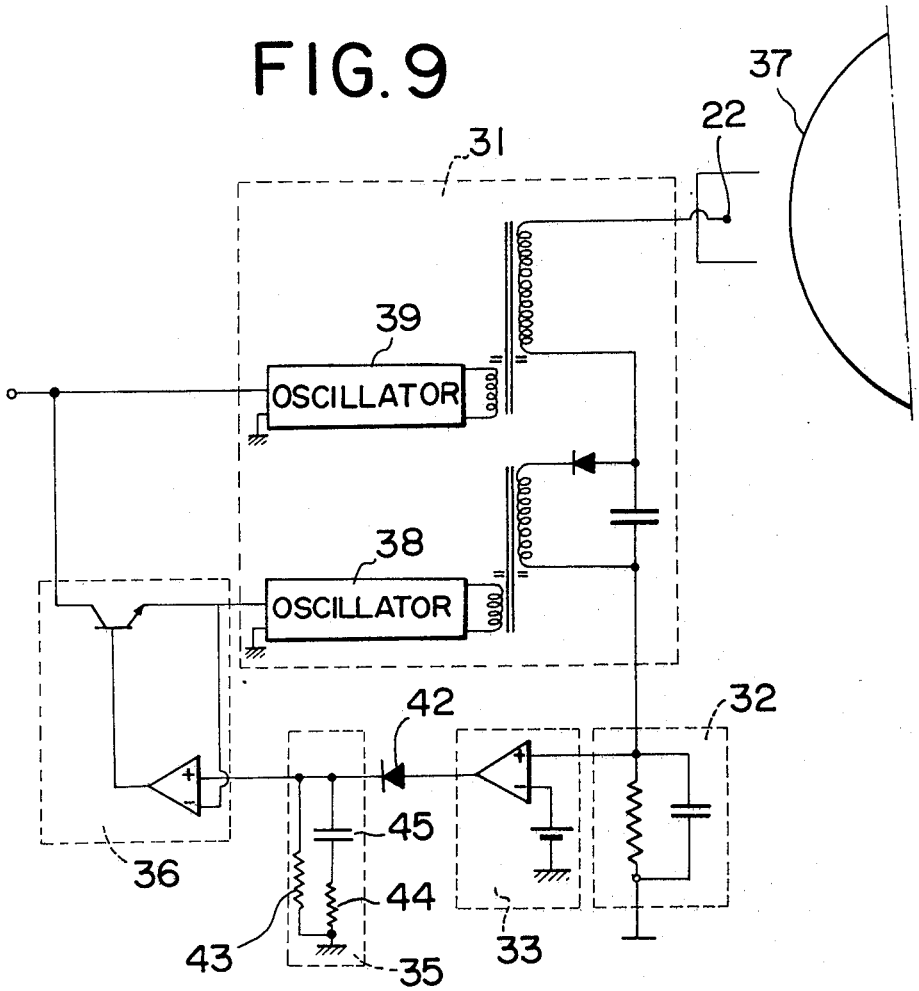
Figure 10:
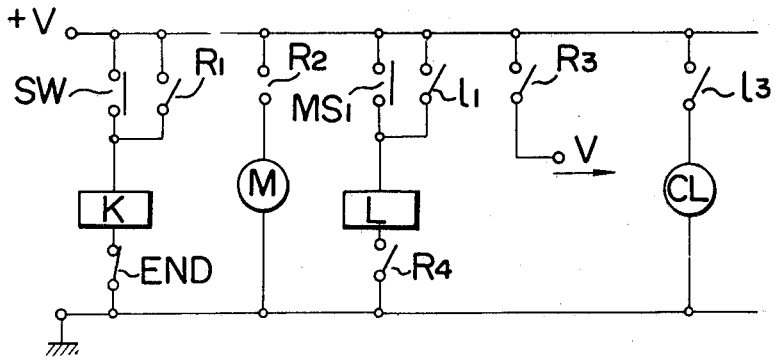
FIG. 10 shows the operating circuit of the switch 34 in FIGS. 4–9.
Figure 11:
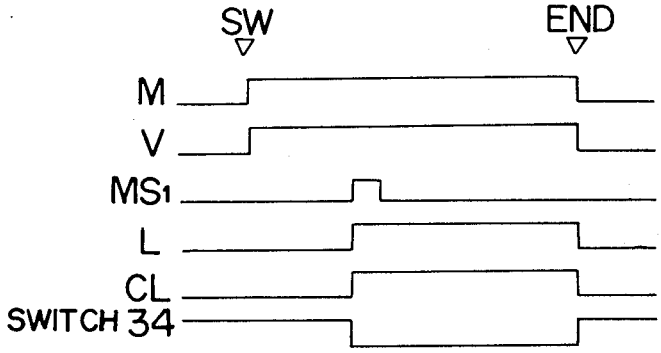
FIG. 11 is a time chart corresponding to the operation in FIG. 10.

FIG. 10 shows an example of such circuit and FIG. 11 is a time chart therefor. In these Figures, V denotes a DC voltage source which provides the power source for the oscillator 38 of FIGS. 3 to 9, and M a motor for rotating the photosensitive drum (indicated by 1 in FIG. 1). MS1 and MS2 are switches adapted to be closed by a cam provided on the drum and corresponding to the drum position. K denotes a relay energized by a main switch SW, L is a relay energized by MS1, and CL is an original supporting carriage forward stroke clutch.

When the main switch SW is closed, the drum is rotated by contacts k1, k2 and k3 closed by the relay K and corona discharge is started. When the drum makes substantially one full rotation, MS1 is closed and the clutch CL is connected by contacts 1 and 2 closed by the relay L, thereby starting the exposure scanning of the original image to initiate the process and open the switch 34 at the same time. The pre-exposure and pre-charging may sometimes be effected by a lamp and a charger provided therefor, but may simply be effected by the use of the existing post-exposure lamp and post-charger.

When a copy end signal END is put out, the relay K and L are deenergized and therefore, corona discharge is effected by a hold signal from the beginning to the end of the process.

The switch 34 may be replaced by a contact switch using a thyristor.

The switch 34 need not always be one which is operated by a signal imparted from outside.

For example, if a condition in which the effective corona current assumes its maximum or its minimum value is chosen as the reference condition of the charged member at the first stage of charging, the function of the switch 34 may simply be performed by a rectifier, FIG. 9 shows such an example.

In the example shown in FIG. 9, the rectifier is applied in the case where the difference in absolute value between the positive and the negative corona current becomes maximum when the charged member 15 is in its reference condition.

Also, a resistor 43 is for automatically discharging and eliminating the control signal stored in the memory unit 35. The connection time of the storage in the memory unit determined by resistors 43 and 44 and a capacitor 45 must be sufficiently longer than the time during which this charging device is operated by one storage and sufficiently shorter than the time required for the variation in environmental conditions such as temperature, humidity, atmospheric pressure, etc. to affect the corona charging.

Figure 15:
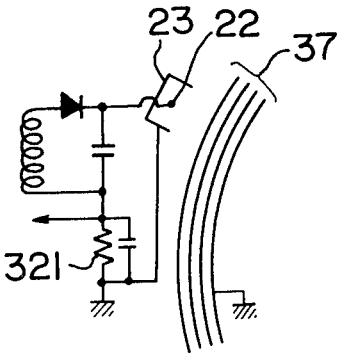
FIGS. 15 and 16 are cross-sectional views of further chargers.
Figure 16:
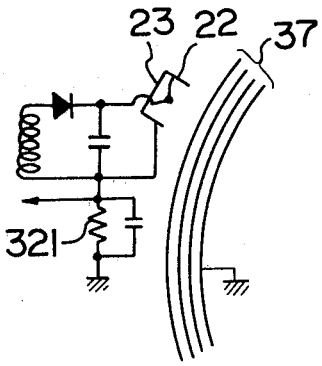

FIG. 15 shows an example in which the shield 23 surrounding the wire 22 of FIGS. 3–8 is conductive and grounded, and FIG. 16 shows an example in which connection is made as shown so that the shield current does not flow to the detector 32. Even in the case where a grid is provided between the wire 22 and the photosensitive medium, the grid may be connected as shown. If the shield 23 is formed of an insulating material, and if the corona current includes an AC component, the simple construction as shown in FIG. 3 may be adopted.

In the various examples described above, provision may be made of an A-D converter for converting the detected current into a digital amount, a comparator for comparing the conversion signal with a reference amount, a memory for storing in digital amount the output control amount of the comparator for providing a predetermined charged potential, and an inverter for converting the control amount into a DC potential amount, and the switch 34 may be provided so that the predetermined potential control and the holding of the potential in the reference condition may be effected in the manner as described previously.

Also, instead of controlling the input of the oscillator, provision may be made of a servomotor sliding the primary tap of the transformer 311 or a servomotor sliding a resistor connected to the primary line so that this motor may be operated by a control signal to provide a predetermined charging potential.

Where the charging method of the present invention is applied to the discharging process taking place at the same time with the application of image light in an electrophotographic apparatus using the three-layer photosensitive medium as shown in FIG. 1, discharging in the dark may be effected, instead of the application of image light, after the primary charging or discharging may be effected while the whole surface of the photosensitive medium is being uniformly exposed to light, in order to provide the reference condition of the photosensitive medium 1.

The application of the image light may take place after one full rotation of the drum for the discharging.

Detection takes place to set a proper output during one full pre-rotation of the drum, whereby the desired surface of the photosensitive medium may be checked to stably control the ensuing image formation without greatly hampering the process speed.

Also, a part of the photosensitive medium may be formed as a portion which is not used for the formation of image and such a portion may be provided with a predetermined electrode an insulator and periodically opposed to the charger, thereby enabling the electrode or the insulator to be used as a charged member in reference condition.

Figure 12:
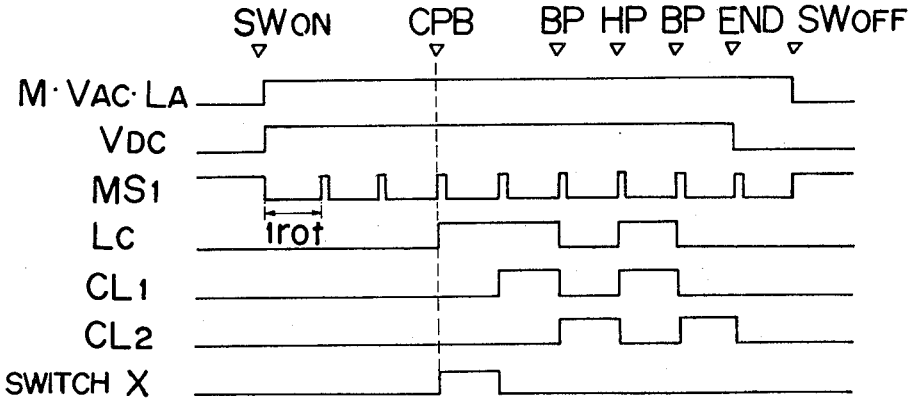
FIG. 12 is a time chart for illustrating an example of the operation in FIG. 1.

Examples of the operation of the various parts of FIG. 1 in the former case are illustrated in the time chart of FIG. 12. M is a signal for operating the main motor to rotate the photosensitive drum 1, VAC is a signal for operating the AC charger 4, LA is a signal for turning on the lamp 5, VDC is a signal for operating the DC chargers 2 and 7, Li, CL1 and CL2 are signals for operating the lamp 10, the optical system forward clutch and the optical system backward clutch, respectively, a switch X corresponds to the switch 34 and is for setting the detection signal, and BP and HP are signals generated when the optical system actuates the switches 51 and 50 (FIG. 14) provided in the path of the optical system and for reventing and stopping the optical system. MS1 is a pulse signal put out for each full rotation of the drum.

Figure 13:
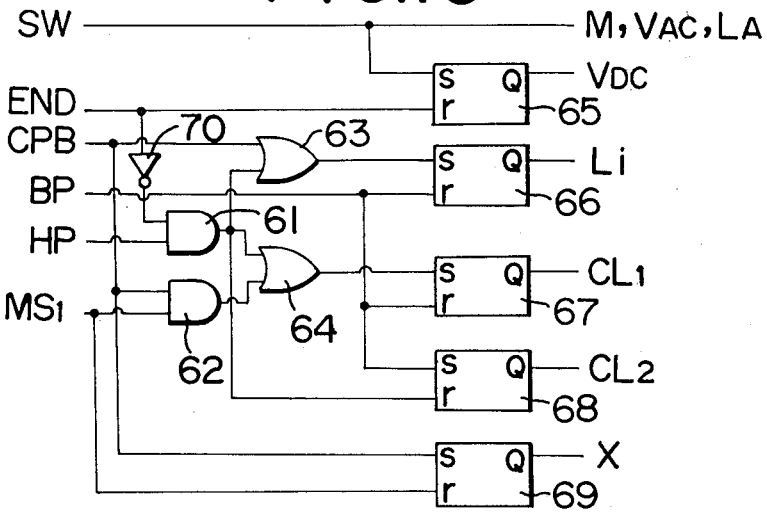
FIG. 13 is a diagram of the circuit for the operation of FIG. 12.

When the drum is rotated with the switch SW closed, the AC charger 4 and the lamp 5 are energized to uniformly discharge the drum and cause the blade 9 to clean the drum. Upon closing of the copy button CPB, the lamp 10 is turned on to uniformly expose the photosensitive drum which makes one full rotation, where after the clutch CL1 is energized to start the scanning. During this pre-rotation, the switch X is closed to effect the detecting operation. When the switch X is closed and opened during the rotation after closing of the switch SW, the detection in the dark can be effected. The Figure shows the case where two copies are to be produced. This operation can be executed by the control circuit of FIG. 13. Designated by 61 and 62 are AND gates. Denoted by 63 and 64 are OR gates. Denoted by 65–69 are flip-flops which are set by the signal to their terminal S and put out 1 from their terminal Q and which are reset by the signal to the terminal r. The flip-flops 65–68 are connected to the trigger portion of a switching element for turning on each load through an amplifier, and the flip-flop 69 is connected to a relay for closing the switch 34 through an amplifier.

Figure 14:
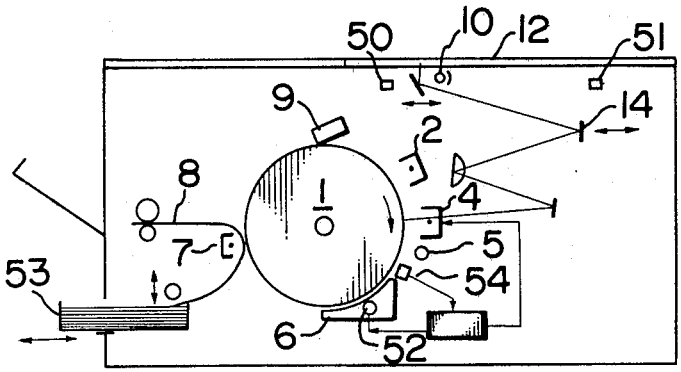
FIG. 14 is a cross-sectional view showing another embodiment.

FIG. 14 shows a modification of the FIG. 1 embodiment. In this modification, the object to be controlled is the bias voltage applied to the sleeve roller 52 of the developing unit 6 and the voltage applied to the lamps 6 and 10. Accordingly, these voltages may be controlled and held in accordance with the detection current to provide a proper image. It is also possible to detect the surface potential of the drum 1 in reference condition directly by a potentiometer 54 and hold the detection signal or the control signal in the manner previously described.

What we claim is:

1. An image forming apparatus comprising:

a plurality of process means for forming an image on a rotatable medium and for transferring the image onto a transfer material;

means for rotating said rotatable medium through an initial one turn without an image forming operation before the start of image formation and for subsequently rotating said rotatable medium for image formation after completion of said initial turn, wherein said rotatable medium is placed in a standard state by uniformly charing it during said initial turn;

detecting means for detecting an electrical condition of one of said process means when said rotatable medium is rotated during the time of said initial turn by said rotating means before the start of image formation; and control means for controlling, during said initial turn, said one process means in response to said detecting means to approach an electrical condition having a predetermined value, memorizing the resultant value of the approaching control and holding it after the start of the image formation during at least the time of the image forming operation, wherein said control means controls, during the image forming operation, said one process means in accordance with the memorized value and independently of said detecting means.

2. An apparatus according to claim 1, wherein said detecting means detects the electric condition while said rotatable medium is being uniformly discharged before the start of image formation.

3. An apparatus according to claim 1, wherein said detecting means detects the electric condition while said rotatable medium is exposed to uniform light before the start of image formation.

4. An image forming apparatus, comprising:

means for forming an image on a recording medium, said means including an AC corona charger for charging the recording medium;

means for detecting a DC component of a corona current of said corona charger when the recording medium is at a reference condition; and control means for controlling, before the start of an image forming operation, said AC corona charger in response to said detecting means such that the DC component of the corona current approaches a predetermined voltage, and memorizing a resultant voltage of the approaching control, said control means controlling said AC corona charger on the basis of the memorized value and independently of said detecting means, during the image forming operation.

5. An apparatus according to claim 4, wherein said reference condition occurs while said recording medium is being uniformly discharged before the start of image formation.

6. An apparatus according to claim 4, wherein the detected corona current is the one flowing through said AC corona charger.

7. An apparatus according to claim 4, wherein, under the reference condition, said detecting means detects a peak current of the corona current.

8. An apparatus according to claims 4, 5, 6, or 7, wherein said control means controls the corona current of said AC corona charger.

* * * * *

UNITED STATES PATENT AND TRADEMARK OFFICE

CERTIFICATE OF CORRECTION

PATENT NO. : 4,346,986

DATED : August 31, 1982

INVENTOR(S) : TSUKASA KUGE, ET AL.

It is certified that error appears in the above-identified patent and that said Letters Patent is hereby corrected as shown below:

Column 2, line 27, "prepartory" should read --preparatory--.

Column 8, line 55, "1 and 2" should read --ℓ1 and ℓ2--;
line 63, "relay" should read --relays--.

Column 11, line 2, Claim 1, "charing" should read --charging--.

Signed and Sealed this

First Day of February 1983

[SEAL]

Attest:

GERALD J. MOSSINGHOFF

Attesting Officer

Commissioner of Patents and Trademarks